United States Patent [19]

Odsvall

[11] 4,354,658

[45] Oct. 19, 1982

[54] HOT TOP CONSTRUCTION

[75] Inventor: Jan Odsvall, Tyresö, Sweden

[73] Assignee: AB Indesko, Stockholm, Sweden

[21] Appl. No.: 210,897

[22] Filed: Nov. 28, 1980

[30] Foreign Application Priority Data

Dec. 6, 1979 [SE] Sweden ..... 7910050

[51] Int. Cl.[3] ..... B22D 7/10

[52] U.S. Cl. ..... 249/202; 164/123; 249/197; 249/204

[58] Field of Search ..... 164/412, 57.1, 123; 249/204, 106, 111, 174, 202, 205, 197, DIG. 5

[56] References Cited

U.S. PATENT DOCUMENTS

| | | | |
|---|---|---|---|
| 1,920,854 | 8/1933 | Gathmann | 249/204 X |
| 2,591,517 | 4/1952 | Daussan | 164/57.1 X |
| 3,923,526 | 12/1975 | Takashima | 249/204 X |

FOREIGN PATENT DOCUMENTS

| | | | |
|---|---|---|---|
| 76029875 | 3/1976 | Sweden . | |
| 1191175 | 5/1970 | United Kingdom | 249/174 |

*Primary Examiner*—Gus T. Hampilos
*Assistant Examiner*—J. Reed Batten, Jr.
*Attorney, Agent, or Firm*—Hane, Roberts, Spiecens & Cohen

[57] ABSTRACT

A hot top consists of a number of sheets of insulating fibrous material. The principally vertical walls of the hot top consist of a number of sheets located close to and joined to one another. When the hot top is placed in an ingot mould, these sheets cover the upper part of the ingot mould walls. The hot top has an upper confinement consisting of one or more sheets of insulating fibrous material which cover the opening formed by the vertical sheets. One or more containers holding additives used in casting are arranged in the space under the confinement. In one preferred embodiment, the walls of the hot top, the upper confinement of the hot top and the hot top containers holding additives form a single unit matched to the dimensions of the ingot mould, so that in a preferred embodiment, the unit is assembled before the hot top is inserted into the ingot mould.

15 Claims, 12 Drawing Figures

HOT TOP CONSTRUCTION

FIELD OF THE INVENTION

This invention relates to a hot top consisting of a number of sheets of insulating, fibrous material in which basically vertical walls of the hot top consist of a number of sheets located close to and joined to one another, these sheets mainly covering the upper part of the walls of an ingot mould when the hot top is placed in the ingot mould. The hot top has an upper confinement consisting of one or more sheets of insulating fibrous material which generally cover the opening formed by the vertical sheets, and one or more containers are arranged in the space below this confinement, to hold additives, e.g. anti-pipe compound, teeming powder, etc., used during casting.

PRIOR ART

The practice, when casting in ingot moulds, of including insulating sheets in a hot top to reduce the rate of heat loss from the smelt is known. The sheets here act as an insulating lining of the top of the ingot mould.

The use of a fibrous material with insulating properties and made of a material containing, for example, pearlite, cellulose filler and a binder is also known. The sheets are cut either from large sheets or are cast to the required form. The hot top is thus built up by joining successive sheets to one another in the ingot mould until all the surfaces are covered. In certain applications, a hot top is formed in which the sheets project above the ingot mould. In the most simple case, the position of the hot top is stabilized by securing the sheets using wedges of the same material at the edges of the sheets. Refer to Swedish patent application No. 7602987-5, for example.

The sheets are also designed with protruding parts, especially when cast sheets are used. These serve as supports which rest against the edge of the ingot mould when the sheets are placed in the ingot mould.

The use of different forms of securing devices for the sheets are also known. The securing devices consist generally of wire elements which are fixed adjacent to the upper part of the ingot mould and to each sheet. A number of solutions employing this principle are known (see, for example, GB Pat. No. 1,111,334; and U.S. Pat. Nos. 3,506,236 and 3,966,167).

During the actual casting, additives, such as anti-pipe compound, teeming powder, etc., are added in accordance with known techniques. For this purpose, the molten steel must be made accessible for the additives. Gas, which can be very troublesome, is generated in conjunction with the addition of additives. The work of adding the additives is also risky. To facilitate the addition of additives, attempts have also been made to batch these in bags to be thrown onto the surface of the steel at a suitable time in the casting procedure. The bags sometimes skid on the surface of the steel and end up at the side of the steel.

The object of anti-pipe compound is to increase considerably the temperature at the top of the ingot. When the reaction which increases the temperature takes place high flames also occur, in addition to the development of gas as mentioned above, and these flames constitute a risk of burns. The high temperatures prevailing in conjunction with casting are also a source of risk of personal injury as soon as manual action is required.

SUMMARY OF THE INVENTION

This invention is directed to a device designed to eliminate completely the problems described above. The invention permits the additives to be placed in the ingot mould before casting the steel, after which the heat from the molten steel ensures that the additives are added at the correct time. The hot top sheets which are fitted in the ingot mould before casting are supplemented by one or more containers for the additives. Each container is made from a material which is destroyed by the heat of the molten steel, thus releasing the additives in the container onto the surface of the molten steel.

In the proposed construction, all the elements, including the container, are secured to one another to form a unit which is matched to the dimensions of the ingot mould before they are placed in the ingot mould. The low density of the material in the sheets makes it possible to place the unit in the ingot mould without physical effort.

In one design of the invention, the container is arranged with a number of compartment above and/or beside each other, for gradual addition of additives during casting. The unit is designed so that one or more sheets form the upper confinement of the hot top and thus preferably also for several containers above one another forming the upper confinement of the uppermost container. The gas generated during casting is removed from the ingot mould through ventilation openings provided between the sheets which form this upper confinement and the principally vertical sheets of the hot top.

The container is preferably made as a box, the top of which is open, and the upper parts of the walls of which are secured adjacent to the upper part of the hot top. The upper parts of the top of the container walls or the extension parts of these are then secured, for example, by being jammed againt the walls of the hot top and/or the upper confinement of the hot top.

The container is made from a material which is matched to the special demands of the intended application. It is usually made from cardboard, preferably with a wall thickness of 0.3–0.8 mm. Other materials, such as metal, wood, etc. may be included in the container. Aluminium has been found to be a suitable material for certain applications. In the versions in which more than one container is arranged in the hot top, the containers are made from different materials in certain applications. The time for the addition of the additives is controlled by the choice of material and material thickness. The concept of the invention also includes the possibility of placing preferably loose linings in the bottom of each container. Such a lining also affects the addition time for the additives as well as having a stabilizing effect on the form of the container. The lining prevents a tendency of the container bottom to sag, especially in the case of large ingot moulds, thus preventing the resulting concentration of the additives to the center of the molten steel. Variation in the thickness of the lining, from the central part of each container to the sides, also offers a possibility of improving the distribution of the additives across the surface of the steel, whenever required.

In one embodiment of the invention, a number of spacer elements are arranged between the upper confinement of the hot top and its walls. The spacer elements may be used to adapt the dimensions of the hot top to those of the ingot mould into which the hot top is to be fitted. In certain embodiments the spacer elements act as spacers to achieve the aforesaid ventilation openings.

As described above, during casting, the heat from the molten steel leads to the burning of the containers and the introduction of the additive into the steel at a suitable point in the casting and/or solidifying process. In the case of more than one container, the heat developed as a result of the anti-pipe compound, added to the steel from a lower container contributes to the burning of the upper container.

The heat generated also results in the destruction of the sheets of fibrous material, so that, according to the invention, a hot top is only intended for a single use. This is acceptable, since the hot top is simple to place in the ingot mould, it increases the safety, increases the yield from each ingot and also costs relatively little as it is of simple construction, is easy to manufacture and is made of relatively cheap materials.

According to the invention, the hot top is placed in the ingot mould before casting and requires no further action during casting or during subsequent solidification. This avoids the risks associated with the generation of gas during casting, while improving the homogeneity of the ingot in comparison with previously known techniques, because the additives used are added at the correct times and are uniformly distributed over the surface of the steel. Practical tests have shown that the return from the ingots is often improved by at least 10% in comparison with results from previously known techniques.

In certain embodiments, the sheet forming the upper confinement of the hot top is movable in relation to the vertical walls of the hot top. When large quantities of gas are generated in the ingot mould, the sheet is lifted from its position of rest, thus eliminating the lifting effect on the hot top which can occur if the ventilation openings described earlier are not capable of releasing the gases generated sufficiently quickly. The upper confinement should preferably only be joined at one edge and preferably by means of hinge-like devices to one or more of the hot top walls. In certain embodiments, the upper confinement is connected to the hot top walls by means of elastic elements. For the case in which the upper confinement consists of two or more sheets arranged beside one another, the number of movable sheets is matched to the expected gas generation in the ingot mould. The hot top and the container still consist of a unit, both before and after the unit is placed in the ingot mould.

BRIEF DESCRIPTION OF THE DRAWING

The invention is described in greater detail in conjunction with a number of figures of the drawing in which.

DETAILED DESCRIPTION

FIGS. 1–5 show an embodiment of the invention, in which a hot top 10 is made of a number of basically vertical sheets 11–14 and an upper confinement shown in the figures as 15*a* and 15*b*. Ventilation openings 16*a*–16*d* and 17*a*–17*d* are formed between the upper confinement 15*a* and 15 *b* and the vertical sheets 11–14. A container 20 containing additives 21, e.g. anti-pipe compound, teeming powder, etc., is arranged below the upper confinement in the cavity formed by sheets 11–14. In certain embodiments, the additive is contained in a separate envelope 22 which in turn is enclosed in the container 20. The container 20 consists preferably of a cardboard box without a top and closed by the confinement 15*a* or 15*b* fitted into the opening of the container. The upper surface of the confinement and the upper edges of the vertical sheets are mainly in the same plane. The vertical sheets and the confinement are secured to each other by securing devices 23*a*–23*d* shown as screws in the figures. The figures also show that the upper wall sections of the container 20 are clamped between the vertical walls 11–14 and the confinement 15*a* or 15*b* during fixing, while in some cases, the fixing devices penetrate the wall material of the container. This determines a location of the container 20 under the confinement. The vertical sheets 11–14 are secured to one another by devices 26*a*–26*d* which, for example, consist of clips connecting the sheets to one another.

Figure 5:
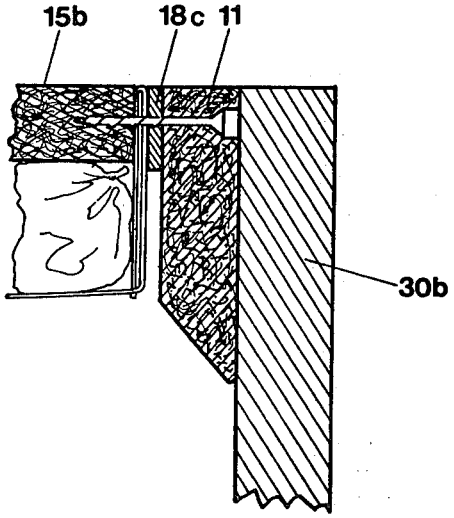
FIG. 5 is a sectional view of a portion of a hot top of the type shown in FIGS. 4*a*, 4*b*, with the hot top located in an ingot mould.
Figure 3:
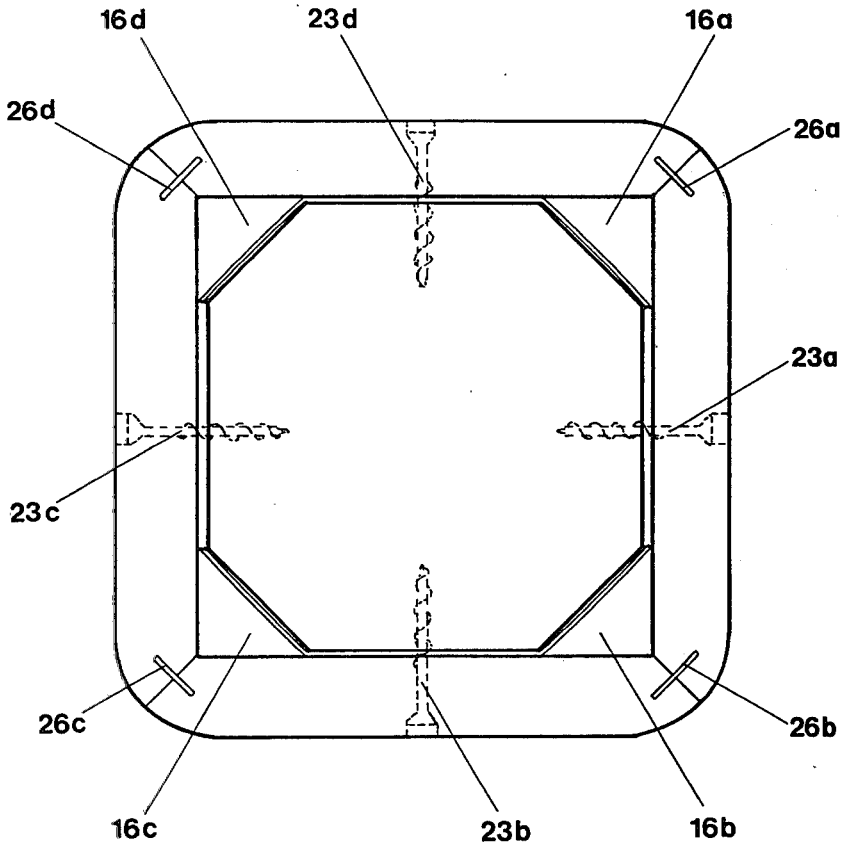
FIG. 3 is a top plan view of the hot top shown in FIG. 1, FIGS. 4*a*, 4*b* are perspective views of an alternative embodiment of a hot top, arranged with spacer elements.
Figure 4A:
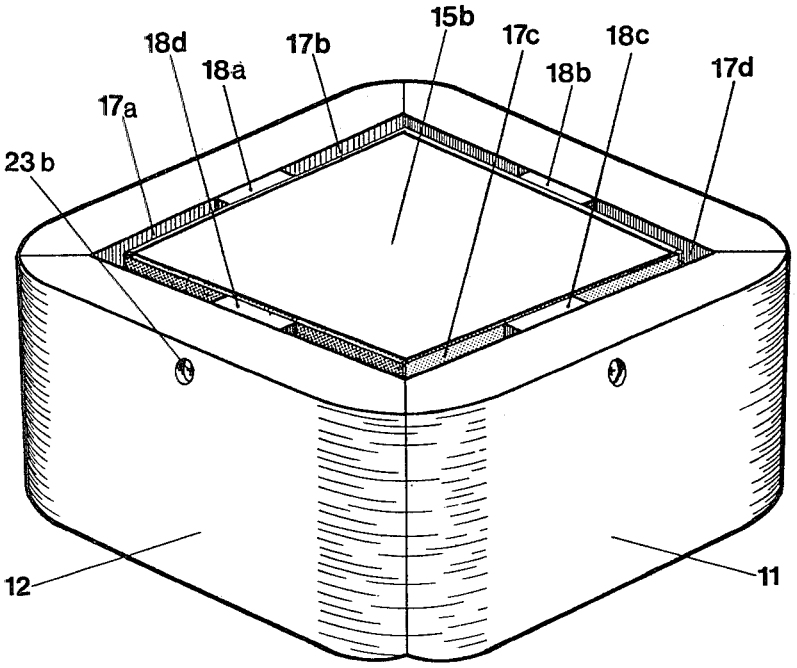
Figure 4B:
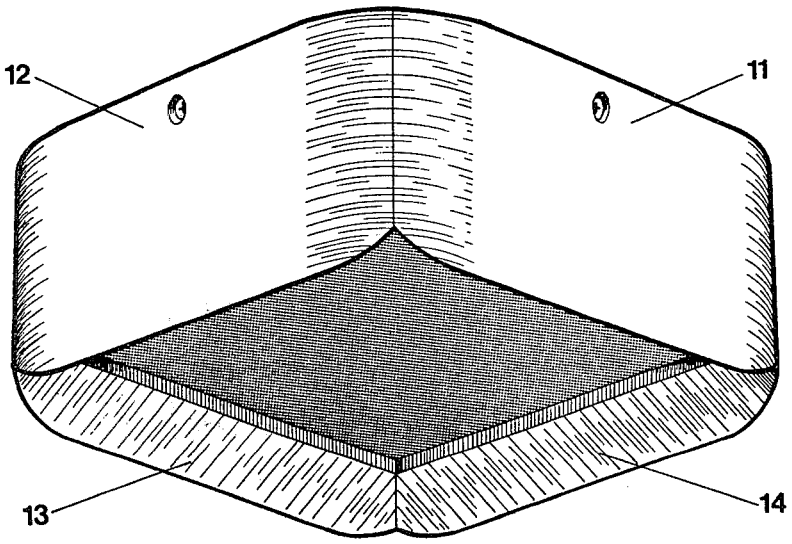
Figure 6:
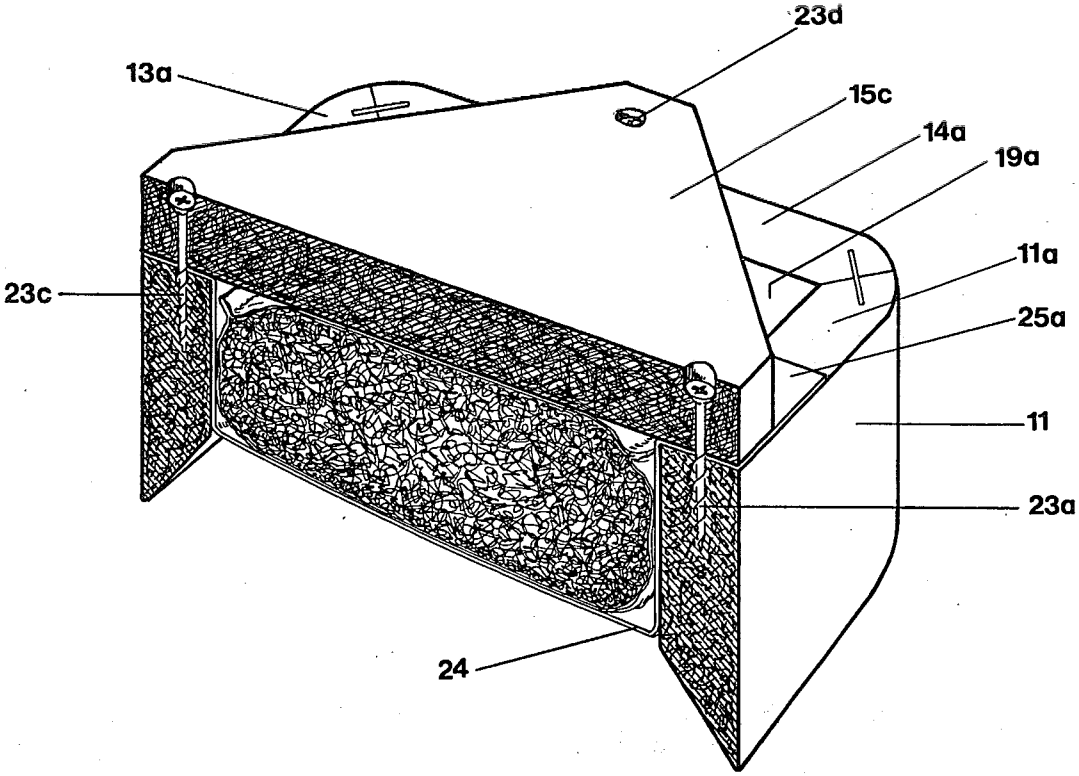
FIG. 6 is a perspective view, partly broken away and in section of an alternative construction of the hot top.

FIGS. 4 and 5 show an embodiment of the invention in which the distance between the vertical sheets 11–14 and the confinement 15*b* is determined by spacer elements 18*a*–18*d*. The spacer elements are preferably located in the region where the securing devices 23*a*–23*d* connect the vertical sheets 11–14 to the upper confinement 15*b*.

The use of spacer elements is shown especially in conjunction with FIG. 4*a*, in which the upper confinement 15*b* has an external edge surface in uniform spacing with the inner confining surfaces of the vertical sheets. The spacer elements are relatively short so that the ventilation openings 17*a*–17*d* are achieved between the upper confinement 15*b* and the vertical sheets 11–14. The size of the ventilation openings is controlled by altering the length and thickness of the spacer elements, so that the openings will be matched to the quantity of gas generated during casting. Even though the use of spacer elements in the figures is only shown in FIGS. 4 and 5 it is clear that spacer elements can be arranged in a corresponding manner in hot tops of the type shown in FIG. 1. The section shown in FIG. 5 is also applicable to the embodiment of the invention just mentioned.

FIGS. 6, 7, 8*a* and 8*b* show an embodiment of the invention in which the upper confinement 15*c* rests against the upper edge surfaces of the hot top walls 11*a*–14*a* and are secured to one another by means of securing devices 23*a*–23*d*. The shape of the upper confinement 15*c* is matched to the shape of the container underneath and chosen so that ventilation openings 19*a*–19*d* are formed between the upper confinement and the vertical sheets of the hot top.

The container 24 is made with outwardly directed flaps 25*a*, 25*c* situated between the confinement 15*c* and the upper edge surfaces of the vertical sheets of the hot top. Thus the fixing of the confinement 15*c* against the upper edge surfaces of the vertical sheets of the hot top means that the flaps 25*a* 25*c* are secured between the confinement and the edge surfaces. Thereby, the flaps act as securing devices as well as bearing devices of the container 24.

The container 24 is of such shape that spaces are formed in the inner corner regions of the hot top, which connect with the ventilation openings 19*a*–19*d*. This design permits gases to be discharged from the hot top.

The flaps 25*a* and 25*c* project beyond the edge surfaces formed by the confinement 15*c*, so that the flaps are accessible for being secured under the fixing of the confinement 15*c* to the vertical sheets of the hot top. The container 24 in this embodiment also forms a box without a top, in which the confinement 15*c* forms the lid of the box.

Figure 7:
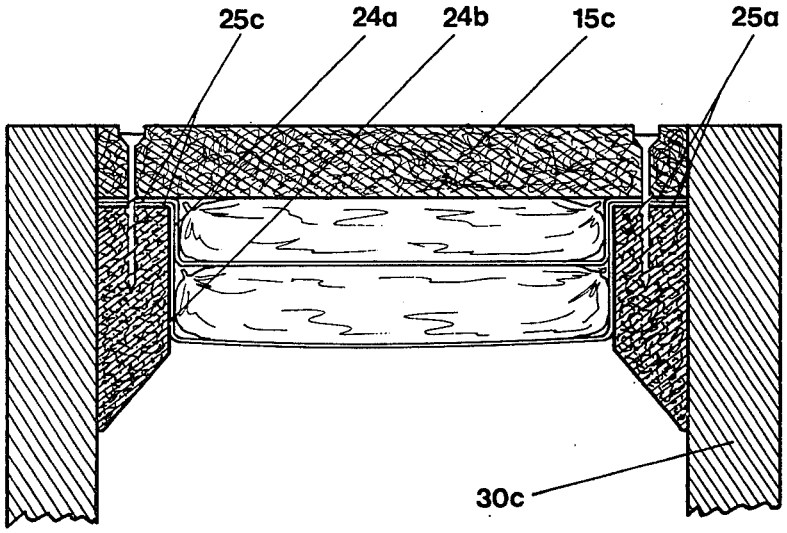
FIG. 7 is a sectional view of the embodiment as shown in FIG. 6, with two containers, one above the other, and with the hot top located in an ingot mould.

FIG. 7 shows an embodiment in which a number of containers 24*a*,*b* are arranged one above the other. In the figure, the flaps 25*a* and 25*c* are arranged in pairs, one above the other. It is especially advisable to arrange the containers at 90° to one another in the case of thick materials. This gives good bearing between the confinement 15*c* and the upper surfaces of the ingot mould walls. This embodiment makes it possible to create relatively small spaces for the additives to ensure uniform distribution of them across the surface of the steel. It also makes it possible to make successive addition of additives during the solidification of the steel. In certain applications, a lining (not shown in the figures) is placed in the bottom of each container to achieve increased stability of the containers and/or to achieve time control of the burning up of the containers and thus the addition of additives during casting and/or solidification. In certain applications, the thickness of the lining varies from the central sections to the sides, thus permitting improved distribution of the additives across the surface of the steel.

Figure 2:
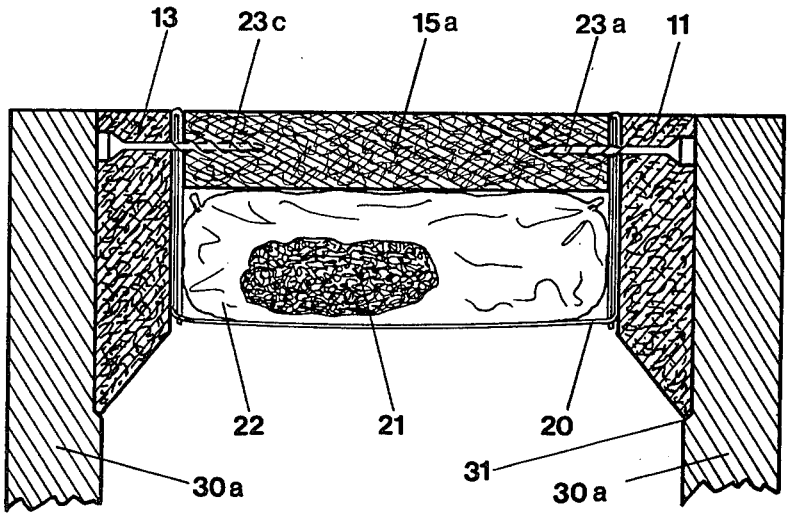
FIG. 2 is a section through a hot top construction of the type shown in FIG. 1, with the hot top located in an ingot mould.

FIGS. 2, 5 and 7 show the hot top located in an ingot mould 30*a*, 30*b* and 30*c* respectively. FIGS. 5 and 7 show embodiments in which the hot top is squeezed into the ingot mould and thus held in the upper part of the ingot mould by friction. FIG. 5 shows how the spacer element 18*c* is also used to adapt the hot top dimensions to those of the ingot mould. As a rule, the ingot moulds have a slightly conical form, which facilitates the fitting of the hot top into the ingot mould. In FIG. 2 the ingot mould wall 30*a* is designed with a shoulder 31 on which the lower edge of the hot top sheets rest. However, the location of a hot top, according to the invention, in the ingot mould is not dependent on any special design of ingot mould. The hot top is therefore generally suitable for use in all types of ingot moulds at present used for casting.

The use of spacer elements 18*a*–18*d*, shown in FIGS. 4 and 5, is only an example of such use. It is clear that in the embodiment shown in FIGS. 6–8, the confinement 15*c* may be of a shape which mainly covers the opening formed by the vertical sheets of the hot top. In this case, spacer elements are arranged between the confinement 15*c* and the upper surfaces of the vertical sheets of the hot top, thus forming the ventilation openings which permit the necessary gas release from the hot top, between the upper confinement and the vertical sheets.

The confinement is shown in the figures as a single sheet. But in certain embodiments, the confinement consists of a number of sheets arranged more or less close to one another.

Figure 1:
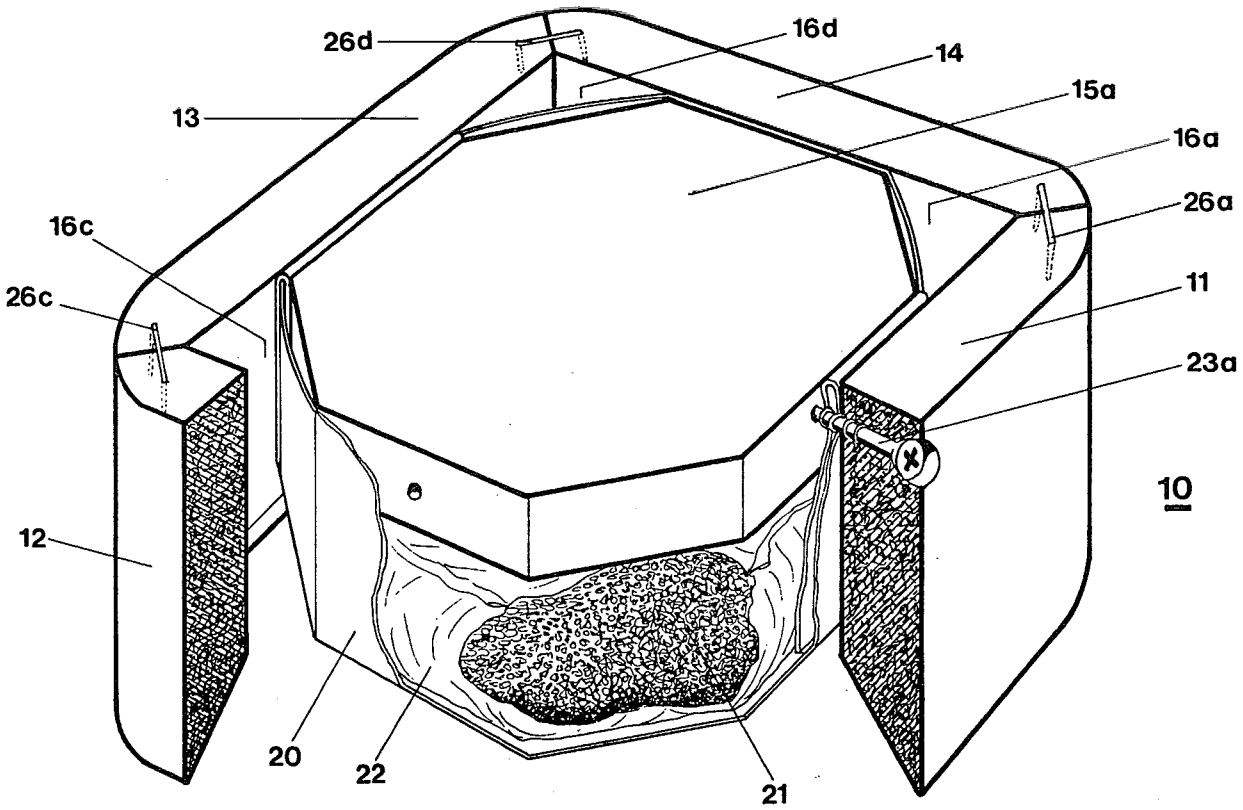
FIG. 1 is a perspective view, partly broken away and in section, of one embodiment of a hot top construction.

The embodiment shown in FIG. 7 with a number of containers 24*a*,*b*, arranged one above the other, is, according to the invention, also applicable to the embodiment of container shown in FIG. 1. In the embodiment shown in FIG. 1, the containers are located inside one another in a corresponding manner, so that different storage levels for the additives are achieved by making the wall sections of the container of different length.

Figure 8A:
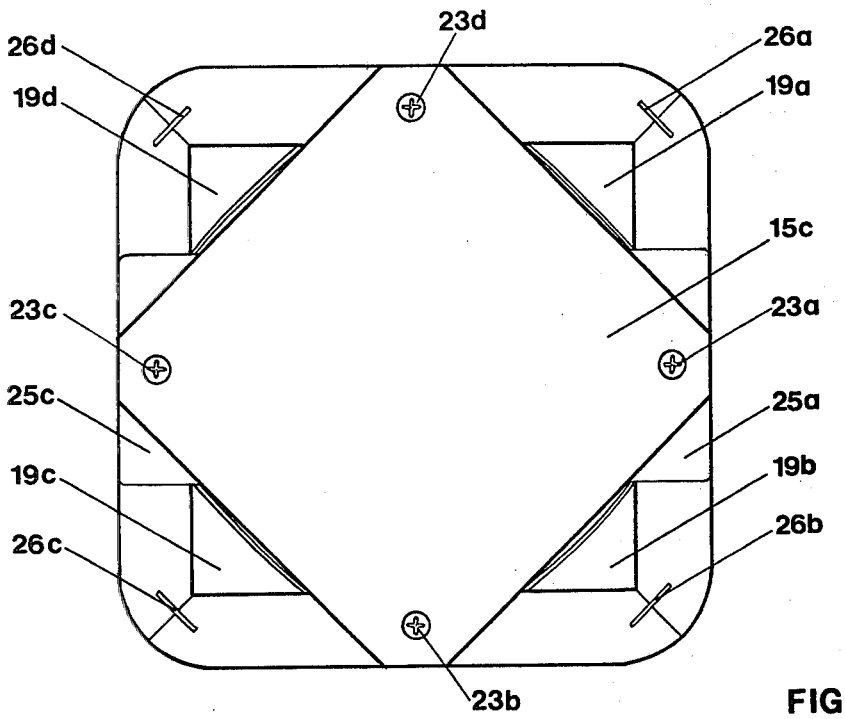
FIGS. 8*a*, 8*b* show the embodiment of the hot top in FIG. 6, seen from above and below.
Figure 8B:
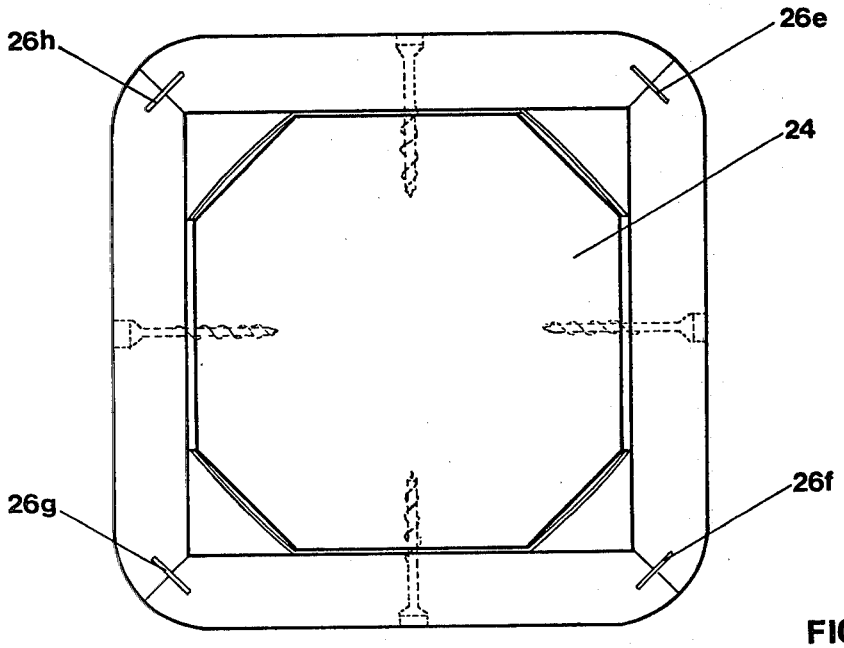
Figure 9:
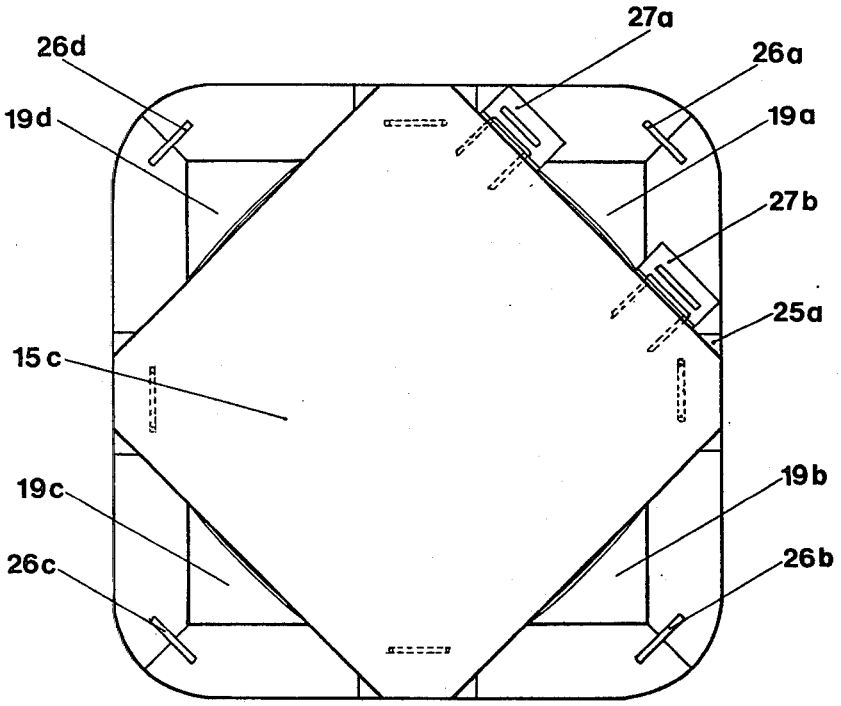
FIG. 9 is a top plan view of an embodiment of the hot top having an upper confinement, which is movable.
Figure 10:
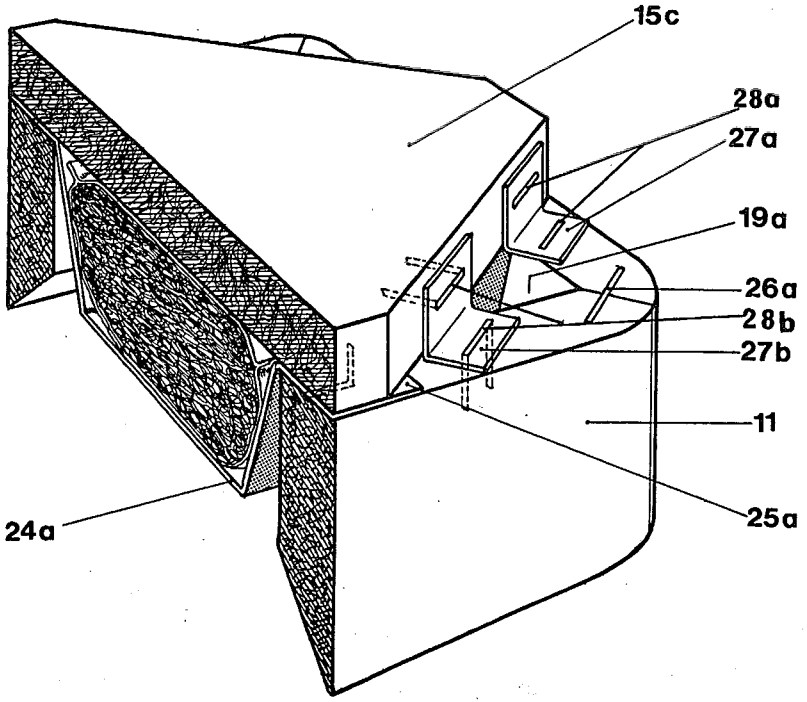
FIG. 10 is a perspective view, partly broken away and in section, of the embodiment shown in FIG. 9.

FIGS. 9 and 10 show an alternative embodiment, in which the securing devices 23*a*–23*d*, as shown in FIG. 8*a*, are replaced by hinge-like connections 27*a*,*b* for securing the upper confinement to the ingot mould walls. The earlier described fixings of the container in the hot top (e.g. FIG. 6) are replaced here preferably by a securing of the container solely to the upper confinement. The hinge-like connections are made of cardboard, for instance, with a crease in the fold between the horizontal and the vertical part of the connections. The hinge-like connections are secured to the confinement and to the sheets of the hot top by clips 28*a*–28*b*. Of course, other securing means can be used, e.g. glue joints, rivets, etc. FIG. 10 shows that the container 24*a* has a conical shape to enable the confinement 15*c* and the container 24*a* to swing up as a unit when excess pressure arises within the ingot mould.

I claim:

1. A hot top construction comprising a plurality of walls of insulating fibrous material, arranged vertically in relation to one another for insertion into an ingot mould to cover the walls of the upper part of the mould, said walls of the hot top construction defining an inner cavity which has upper and lower open ends, an upper confinement member of insulating fibrous material mounted at said open upper end, at least one combustible container containing an additive to be supplied to the melt during casting, and means securing said container below said upper confinement member in said cavity to form an assembled unit adapted to the dimensions of the ingot mold.

2. A hot top construction as claimed in claim 1 wherein a plurality of said containers are supported one above the other in said cavity and are so constructed to be combustible at different times to release their additives at separate times.

3. A hot top construction as claimed in claim 2 wherein said containers are made of the same material and have different thicknesses.

4. A hot top construction as claimed in claim 2 wherein said containers are made of different materials.

5. A hot top construction as claimed in claim 1 wherein said container has a plurality of compartments for gradual addition of additives during casting.

6. A hot top construction as claimed in claim 1 wherein said upper confinement member and said walls define ventilation spacing means for passage of gases from the mould during casting.

7. A hot top construction as claimed in claim 6 wherein said ventilation spacing means includes a passage between said upper confinement member and said walls, the gases produced during combustion flowing past said container to said passage for escape to the ambient environment.

8. A hot top construction as claimed in claim 1 wherein said container comprises a cardboard box with a wall thickness of 0.3–0.8 mm and having an upper part secured to the vertical walls at the upper part thereof.

9. A hot top construction as claimed in claim 1 wherein said container comprises an open-top box having upper wall sections arranged between said vertical walls and said upper confinement member whereby said upper confinement member also serves as an upper confinement for the container.

10. A hot top construction as claimed in claim 9 wherein said upper wall sections of said container are clamped against said vertical walls and said upper confinement member.

11. A hot top construction as claimed in claim 1 further comprising spacer means interposed between said vertical walls and said upper confinement member for adapting the size of said unit to that of said mould.

12. A hot top construction as claimed in claim 1 further comprising spacer means interposed between said vertical walls and said upper confinement member for forming ventilation passages for escape of gases during casting.

13. A hot top construction as claimed in claim 1 wherein said upper confinement member is secured to said walls such that an upper surface of said upper confinement member is disposed in a common plane with upper edges of said vertical walls, said container having upper edge sections clamped between said walls and said upper confinement member whereby said container is suspended in said cavity.

14. A hot top construction as claimed in claim 1 further comprising means securing said upper confinement member to said walls to permit relative displacement of said upper confinement member with respect to said walls such that with intense gas generation in said mould the confinement member and the container are movable to release gas and reduce excess gas pressure in the mould.

15. A hot top construction as claimed in claim 14 wherein the means securing the upper confinement member to said walls comprises a hinge connection permitting pivotal movement of said upper confinement member with respect to said walls.

* * * * *